US007185793B2

(12) United States Patent
Miranda

(10) Patent No.: US 7,185,793 B2
(45) Date of Patent: Mar. 6, 2007

(54) CLOSING DEVICE FOR RECIPIENTS

(75) Inventor: Renato Miranda, Sao Paulo (BR)

(73) Assignee: Globalpack Industria E. Comercio Ltda., Sao Paulo (BR)

( * ) Notice: Subject to any disclaimer, the term of this patent is extended or adjusted under 35 U.S.C. 154(b) by 420 days.

(21) Appl. No.: 10/746,941

(22) Filed: Dec. 23, 2003

(65) Prior Publication Data

US 2004/0182861 A1 Sep. 23, 2004

(30) Foreign Application Priority Data

Dec. 27, 2002 (BR) ..... 0205286
Oct. 31, 2003 (BR) ..... 0304971

(51) Int. Cl.
*B65D 47/00* (2006.01)

(52) U.S. Cl. ..... 222/548

(58) Field of Classification Search ..... 222/548
See application file for complete search history.

(56) References Cited

U.S. PATENT DOCUMENTS 6,386,404 B1 * 5/2002 Auer ..... 222/548

* cited by examiner

*Primary Examiner*—Philippe Derakshani
(74) *Attorney, Agent, or Firm*—Darby & Darby

(57) ABSTRACT

A closing device for recipients provided with a nozzle and a cap and having a cylindrical seat provided in the nozzle and having at least one radial window in communication with the recipient; a cylindrical tubular seal affixed to the interior of the cap, having at least one radial opening and being fitted and journalled in the interior of the seat; and a sealing means, incorporated in the interior of the cap and being seated against the free end of the seat to seal it, said cap having an axial orifice opened to the interior of the cylindrical tubular seal and being selectively angularly displaced between an opening position, and a closing position.

21 Claims, 15 Drawing Sheets

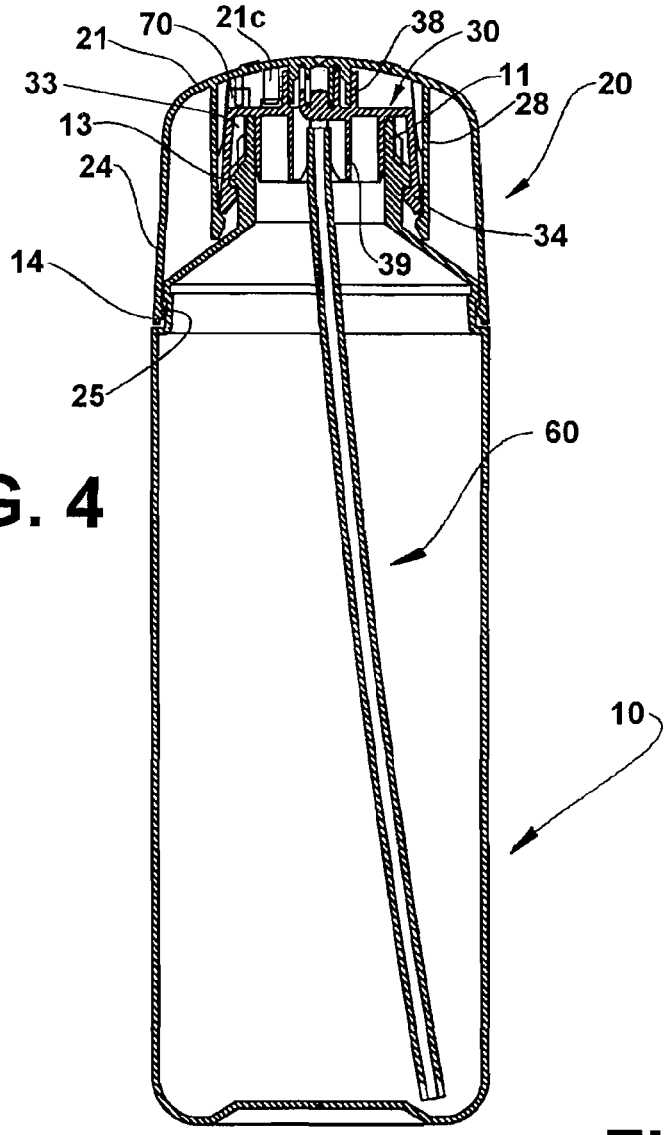
FIG. 4
FIG. 10
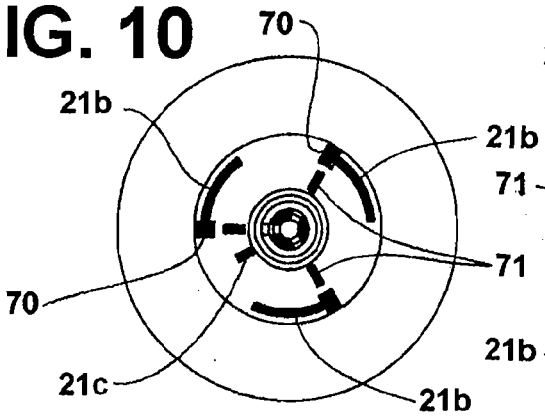
FIG. 11
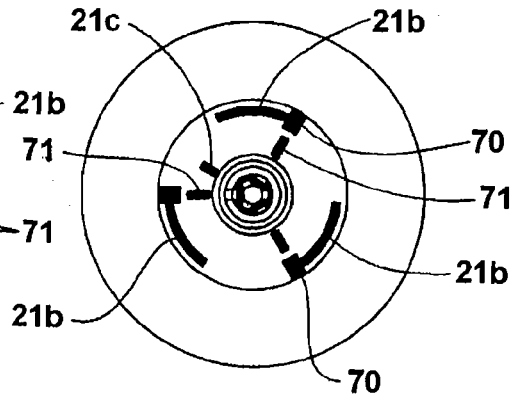

CLOSING DEVICE FOR RECIPIENTS

FIELD OF THE INVENTION

The present invention refers to a closing device to be applied to flasks, tubes, and other recipients which are constructed in a flexible material so as to be selectively manually squeezed, by exerting mechanical pressure around the surface thereof, for dispensing the liquid or pasty product contained therein.

PRIOR ART

There are well known from the prior art different constructive solutions for obtaining the closure of flasks or tubes, which are manually deformed by mechanical pressure to dispense the stored product through an opening which generally takes the form of an orifice, in the case of liquid products, such as deodorants, or the form of an extrusion nozzle, which is usually provided in the tubes containing pasty products.

A known closing device, to provide the closure and the opening of flasks and tubes, comprises the usual caps threaded to the nozzle of the flask or tube so as to be axially retained to the latter in a condition in which they are seated against the outlet opening of the product, closing the recipient. In other solutions, the retention of the cap in the closed position is obtained only by interference fitting, using the elastic deformation of at least one of the parts defined by the recipient and the cap.

In these constructive solutions, the opening and the closing operations of the flask or tube require the cap to be manually detached from and repositioned over the body of the recipient containing the product, said operations being associated with certain skill and care and causing discomfort to the user, mainly in situations in which it is difficult to hold the cap while the product is being dispensed and applied.

Other constructive solutions use caps provided with one or more eccentric openings and which are axially retained onto the nozzle of a recipient, usually a flask, so as to be manually rotated around an axial axis between a closing position, in which said openings are positioned over an end wall provided in the nozzle of the recipient, and an opening position, in which the openings of the cap are partially or totally aligned with corresponding windows provided in said end wall of the recipient. While eliminating the discomfort of removing the cap for opening the recipient, these constructive solutions do not assure the necessary tightness for the closing device in case liquid and pasty products are stored. These caps are only applied to recipients designed to contain powdered products, which do not require a high degree of tightness in the closing device.

The attempts to provide a closing device which can be incorporated to flasks or tubes and which presents a practical, comfortable and reliable operation have resulted in complex constructions which undesirably increase the cost of the package of the liquid or pasty products, such as deodorants, creams, and the like.

OBJECTS OF THE INVENTION

By reason of the deficiencies presented by the known constructive solutions, it is a general object of the present invention to provide a closing device with a simple construction, which is reliable in terms of tightness and versatile, and which can be incorporated to flasks and tubes and operated through an easy angular movement of the cap of the recipient.

It is a further object of the invention to provide a closing device such as mentioned above, which can limit the operational movement effected by the user, in order to guarantee the correct positioning of the closing means in the opening and closing conditions of the recipient.

It is still a further object of the invention to provide a closing device such as mentioned above, which provides the user with a sound signal, indicating an alteration occurred from the closing condition to the opening condition and vice-versa, upon the operational movement of the closing device between said operative conditions.

It is a complementary object of the present condition to provide a closing device such as mentioned above, which allows for the application of a tamper evident seal.

SUMMARY OF THE INVENTION

The closing device of the present invention is applied to recipients in the form of a flask or tube, made of flexible material and which are provided with a nozzle covered by a cap which is axially locked to the recipient so as to be selectively angularly displaced around its axis.

According to the invention, the closing device comprises a seat in the form of a cylindrical housing provided in the nozzle and having an outwardly opened free end, and at least one radial window defining the single communication between the interior of the seat and the interior of the recipient. There are also provided a cylindrical tubular seal axially affixed into the interior of the cap, having at least one radial opening and being fitted and journalled in the interior of the seat; and a sealing means incorporated in the interior of the cap and seated against the free end of the seat in order to seal it. The cap presents an axial throughbore opened to the interior of the cylindrical tubular seal and being selectively angularly displaced around its axis between an opening position, in which there occurs the alignment between the radial window and the radial opening and the communication between the interior of the recipient and the axial orifice of the cap, and a closing position, in which the radial opening is offset from the radial window, blocking the communication between the interior of the recipient and the interior of the cylindrical tubular seal.

Regarding flasks, the seat of the closing device can be defined by an axial insert, rotatably locked in the nozzle of the flask and onto which is mounted the cap carrying the cylindrical tubular seal.

In case the recipient has the form of a tube, which will have its basic end portion closed after being filled with the product, the nozzle of the tube may be constructed so as to define, in a single piece with the tube, the seat of the closing device.

BRIEF DESCRIPTION OF THE DRAWINGS

The invention will be described below, with reference to the enclosed drawings, given as a way of example of possible embodiments for the present closing device, and in which:

FIG. 4 is a longitudinal sectional view of the components illustrated in FIGS. 1–3 in the mounted condition;

FIGS. 10 and 11 are schematic views indicating the position of the elements of the cap in relation to the elements of the recipient, respectively in the opening and closing positions of the closing device;

DESCRIPTION OF THE ILLUSTRATED EMBODIMENT

Figure 1:
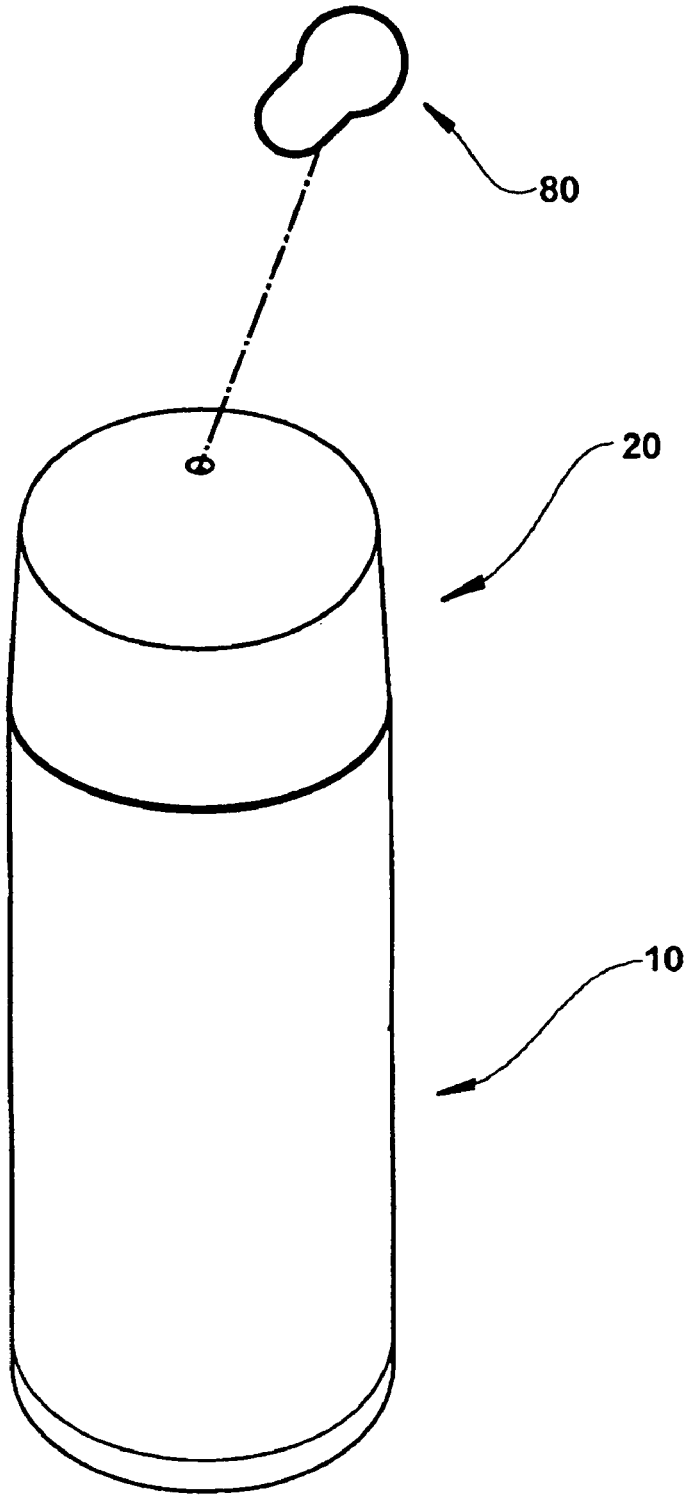
FIG. 1 is an upper lateral perspective view of a possible model for a flask provided with a cap and to which the present closing device can be applied, further illustrating, in an exploded way, a tamper evident seal which evidences the previous use of the content of the flask.
Figure 2:
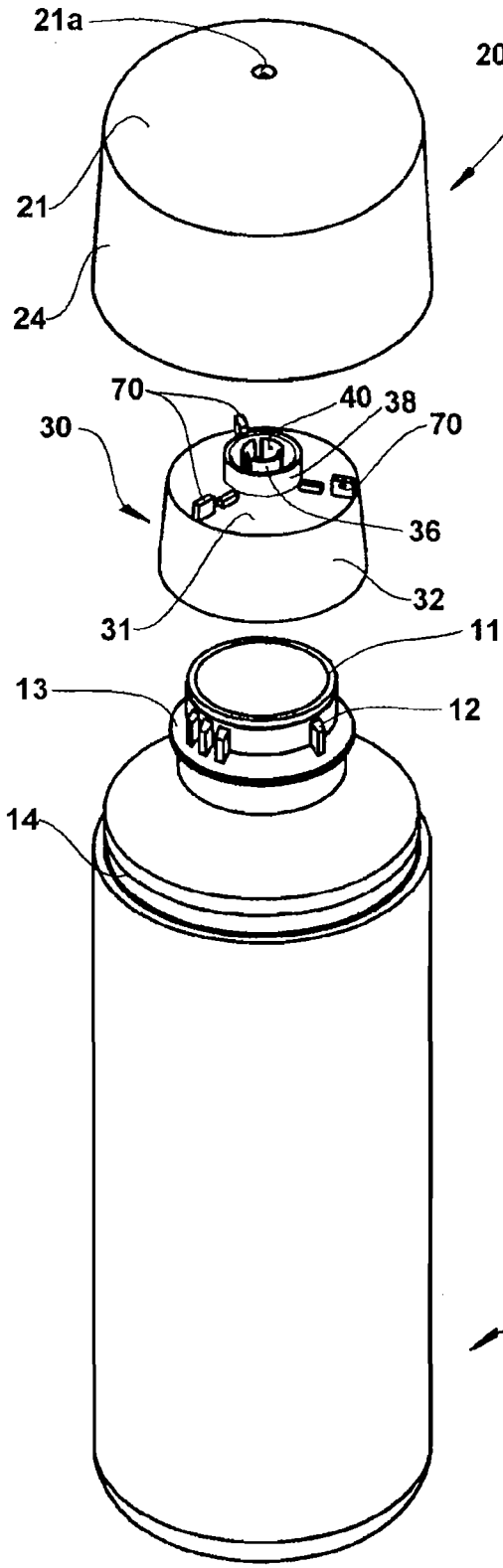
FIG. 2 is a similar view to that of FIG. 1, but illustrating the flask, the cap, and an insert that defines the seat of the closing device in an exploded condition and according to a first embodiment of the invention.
Figure 3:
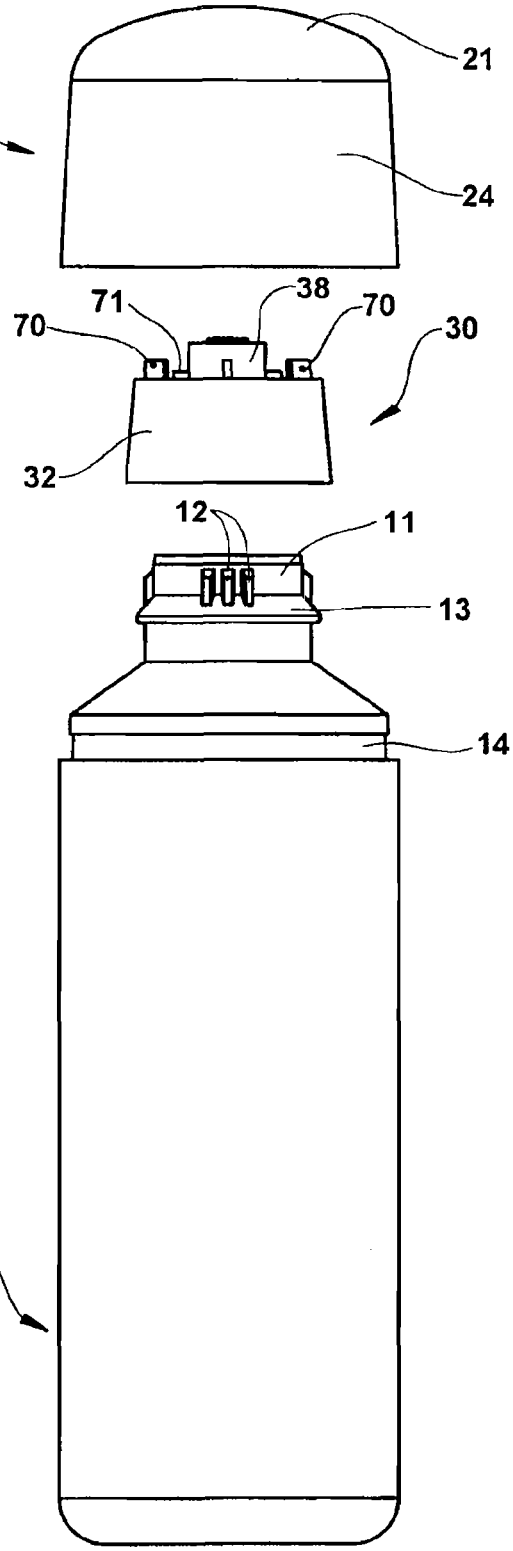
FIG. 3 is an elevational lateral view of the exploded assembly of FIG. 2.
Figure 5:
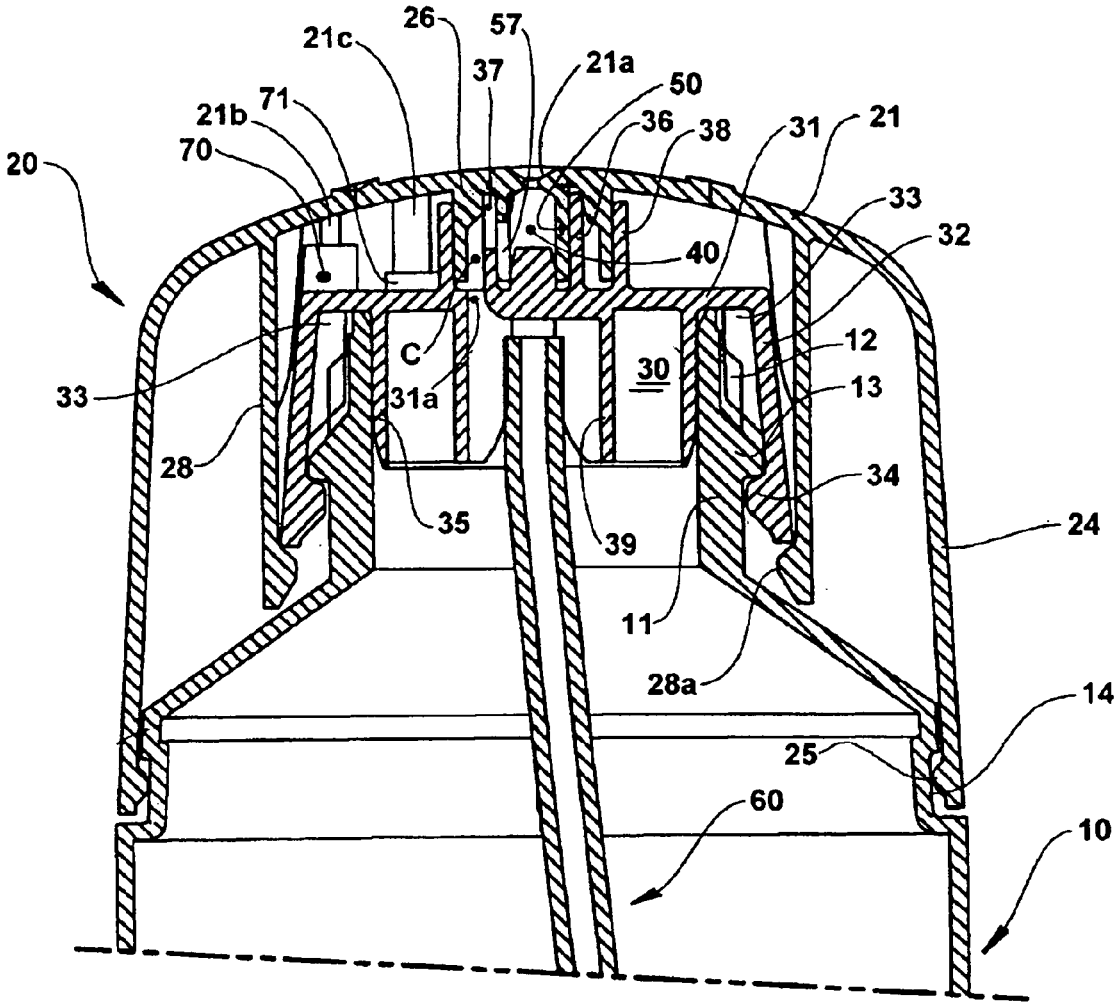
FIG. 5 is an enlarged detail of the top portion of the flask-cap assembly illustrated in FIG. 4.
Figure 6:
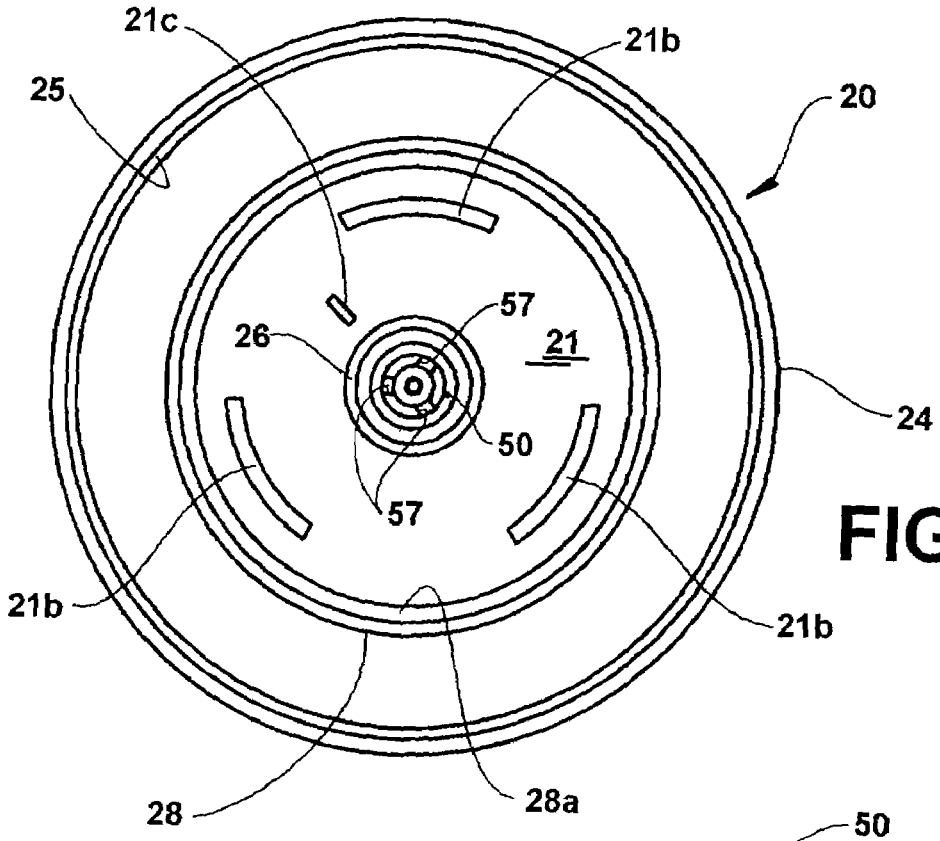
FIG. 6 is a lower plan view of the cap illustrated in the previous figures.
Figure 7:
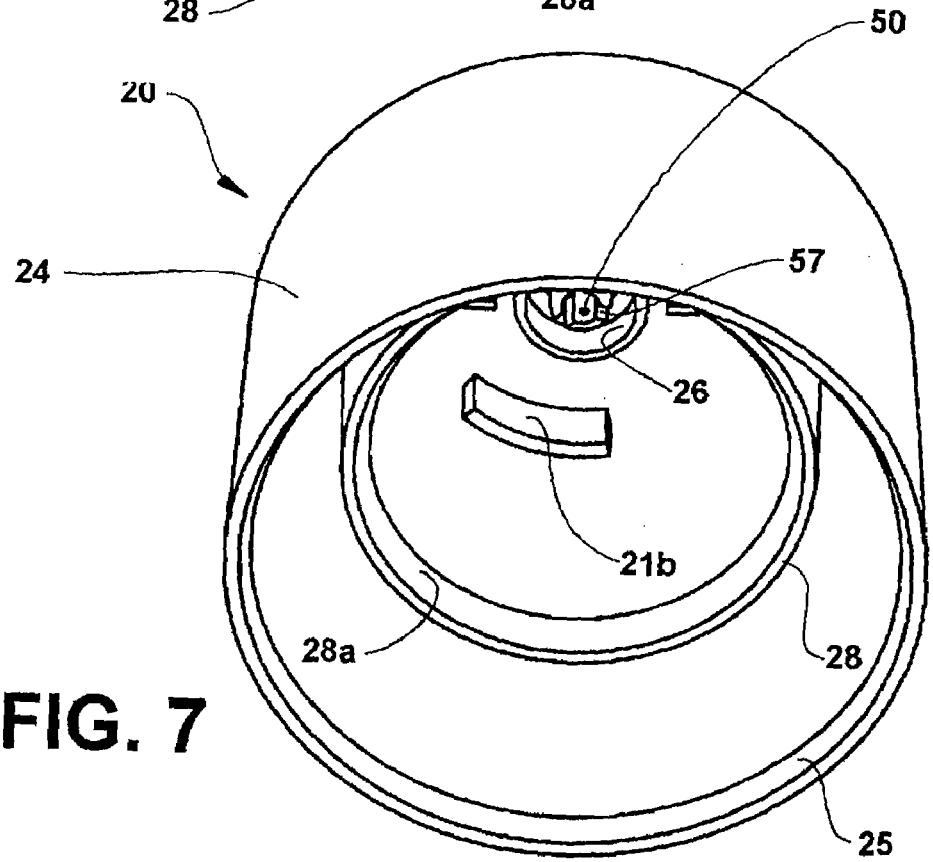
FIG. 7 is a lower perspective view of the cap of the flask of the previous figures.
Figure 8:
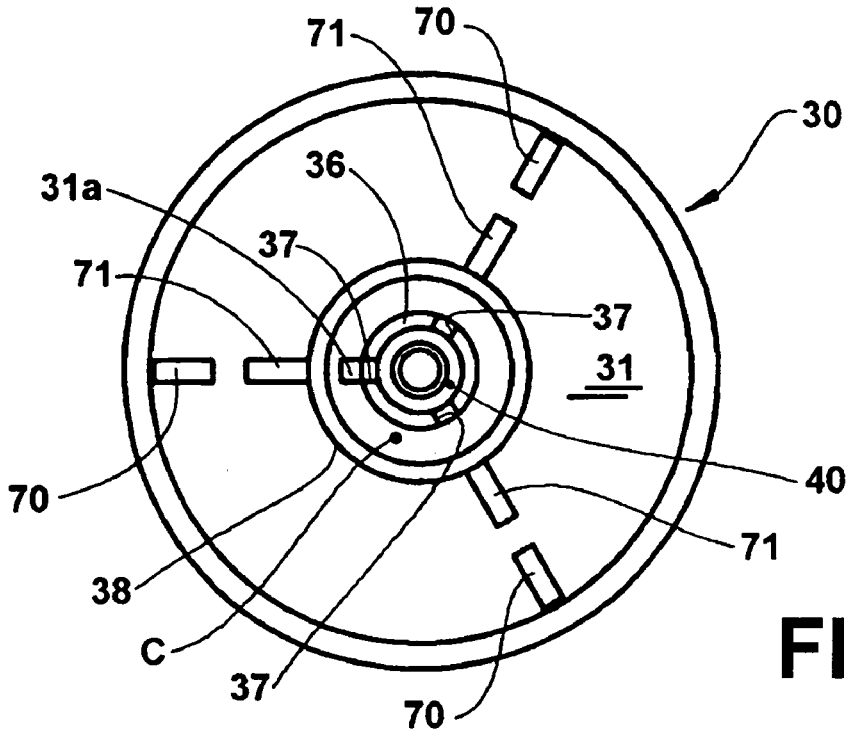
FIG. 8 is an upper plan view of the insert that defines the seat of the closing device, according to said first embodiment of the invention.
Figure 9:
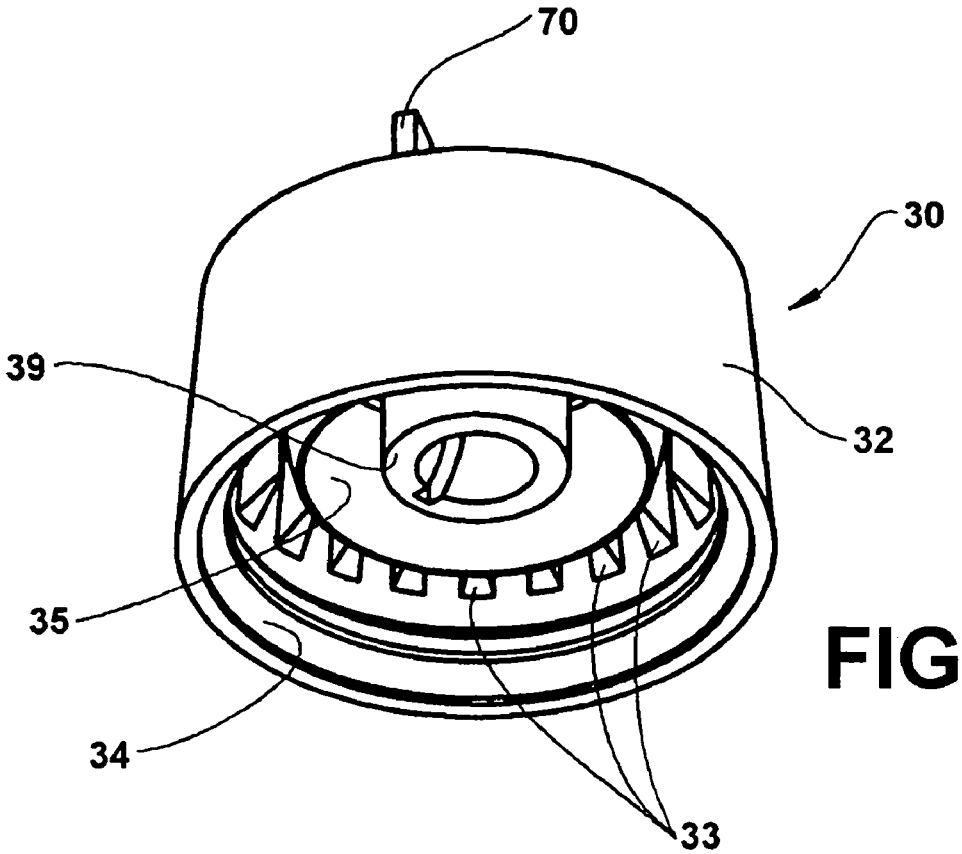
FIG. 9 is a lower perspective view of the insert of FIG. 8.

According to the embodiment illustrated in FIGS. 1–11 of the enclosed drawings, the present closing device is applied to a recipient 10 in the form of a flask generally made of a flexible material, for example plastic, presenting any shape that is adequate to contain the product to be stored, which in this case is a liquid, for example a deodorant. The recipient 10 presents a nozzle 11 projecting outwardly from the recipient and which may present any polygonal contour, for example circular, as illustrated.

In the illustrated construction, the nozzle 11 incorporates a plurality of longitudinally arranged external ribs 12 and also a circumferential salience 12, located under the ribs 12 and whose function will be described below.

The recipient 10 further presents, in its region close to the nozzle 11, a peripheral groove 14 of circular development, inside which is slidingly lodged an internal end rib 25 of the lateral skirt 24 of a cap 20, also made of plastic material and incorporating an upper end wall 21 that covers the nozzle 11 when mounted to the recipient 10, allowing said cap 20 to be angularly displaced, by a certain extension, around its longitudinal axis.

For the type of recipient 10 described above, the closing device comprises an insert 30, generally of plastic material and defined as a tubular body having an end wall 31, dimensioned to be seated and affixed against the nozzle 11, and a surrounding lateral wall 32, externally involving the nozzle 11 and which incorporates a plurality of internal ribs 33 between which the external ribs 12 of the cap 11 are fitted, rotatably locking the insert 30 to the nozzle 11 of the recipient 10.

The surrounding lateral wall 32 of the insert further incorporates an internal end circumferential rib 34, which may be continuous or formed by circumferential extensions and which will be fitted, by elastic deformation, under the circumferential salience 13 of the nozzle 11, guaranteeing the axial lock of the insert 30 to the recipient 10, with the end wall 31 of the former being forcedly seated against the nozzle 11, more precisely against an end edge of the latter.

The insert 30 further incorporates, internally, an axial tubular projection 35 that is dimensioned to be tightly fitted by interference in the interior of the nozzle 11, guaranteeing the necessary tightness for the junction defined between the nozzle 11 and the insert 30.

It should be understood herein that the nozzle 11, the insert 30, and the cap 20 may present cross sections different from the illustrated circular cross section, provided they maintain the circumferential contour of the regions that support and lock the cap 20, as discussed ahead.

The end wall 31 of the insert 30 incorporates a first external axial tubular projection 36 provided with at least one, but preferably three radial windows 37, said first external axial tubular projection 36 being outwardly opened at its free end and configured to define, in its interior, a cylindrical housing that defines the seat 40 of the closing device. The construction of the closing device is constructed so that the radial windows 37 consist in the single communication between the interior of the seat 40 and the interior of the recipient 10, as described below.

Another element of the closing device comprises a cylindrical tubular seal 50, defined, preferably, by an internal axial tubular projection of the upper end wall 21 of the cap 20, said cylindrical tubular seal 50 being dimensioned to be fitted and journalled inside the seat 40, being able to rotate together with the cap 20. The cylindrical tubular seal 50 is provided with at least one, but preferably three, radial openings 57, equally angularly spaced from each other and which may be aligned or offset in relation to respective radial windows 37 of the seat 40, as a function of the angular displacement of the cap 20, in order to open and close the closing device, respectively.

The upper end wall 21 of the cap 20 is provided with an orifice 21*a* that promotes the constant communication between the interior of the cylindrical tubular seal 50 and the exterior of the cap 20 and, consequently, of the recipient 10, so us to allow the product to be discharged when pressurized inside the recipient 10.

The closing device further comprises a sealing means 26, defined by an internal projection of the upper end wall 21 of the cap 20 and which is seated against the free end of the seat 40, in order to seal it. The sealing means 26 takes the form of a tubular projection, external and concentric to the seat 40 and which is fitted and tightly journalled in the interior of a second external axial tubular projection 38 of the end wall 31 of the insert 30. Between the second external axial tubular projection 38 and the first external axial tubular projection 36 there is defined an annular chamber C, which is closed, inferiorly, by the end wall 31 of the insert 30 and, superiorly, by the sealing means 26 carried by the cap 20. The end wall 31 of the insert 30 is provided with a throughbore 31*a* to provide a constant communication between the interior of the recipient 10 and the interior of the annular chamber C.

In the construction illustrated in FIGS. 1–11, the cap 20 further incorporates an internal axial tubular wall 28 provided with an internal end rib 28*a* to be seated, by elastic deformation of the internal axial tubular wall 28, under a stop means carried by the surrounding lateral wall 32 of the insert 30, which stop means can be defined by the free end edge of said surrounding end wall 32, or by any other part of the insert 30, or of the recipient 10 itself.

This construction allows the cap 20 to remain securely and axially locked against the insert 30 and the recipient 10, while being selectively angularly displaced around its axis, between an opening position, in which there occurs the alignment between each radial window 37 and a respective radial opening 57, as well as the communication, by means of the throughbore 31*a* and the annular chamber C, between the interior of the recipient 10 and the axial orifice 21*a* for the exit of the product through the upper end wall 21 of the cap 20, and a closing position, in which the radial opening 57 is offset from the radial window 37, blocking the communication between the interior of the recipient and the interior of the cylindrical tubular seal 50 that is open to the exterior through the axial orifice 21*a* of the upper end wall 21 of the cap 20.

In the exemplary construction in which the recipient is a flask for liquids, the closing device further comprises an internal axial nozzle 39 incorporated to the end wall 31 of the insert 30, configured to receive and affix the upper end of a collecting tube 60 and which is maintained in communication with the throughbore 31*a* of the end wall 31 of the insert 30 and with the interior of the recipient 10, so as to allow the exit of air together with the liquid.

To limit the rotation of the cap 20 effected by the user, so as to guarantee the easy and simple opening and closing operative conditions, the insert 30 is provided with stops 70, externally incorporated to the end wall 31 and which, by being preferably three, allow the cap 20, in any mounting position thereof, to be generally rotated in about 60°, so as to be displaced from one operative position to the other. Thus, the upper end wall 21 of the cap 20 is internally provided with saliences 21*b*, between which the stops 70 are relatively displaced during the movements of the cap 20.

The end wall 31 of the insert 30 further incorporates three external steps 71, one of them interfering with the path of a tab 21*c* which is incorporated internally to the upper end wall 21 of the cap 20 when the latter is angularly displaced between its opening and closing operative positions, producing a "click" sound indicating to the user an alteration occurred in the operative condition of the closing device.

It should be noted that in the recipients 10 in which the bottom is generally closed after the formation of the body incorporating the nozzle 11, the insert 30 is incorporated in a single piece to the nozzle 11 of the recipient.

Figure 12:
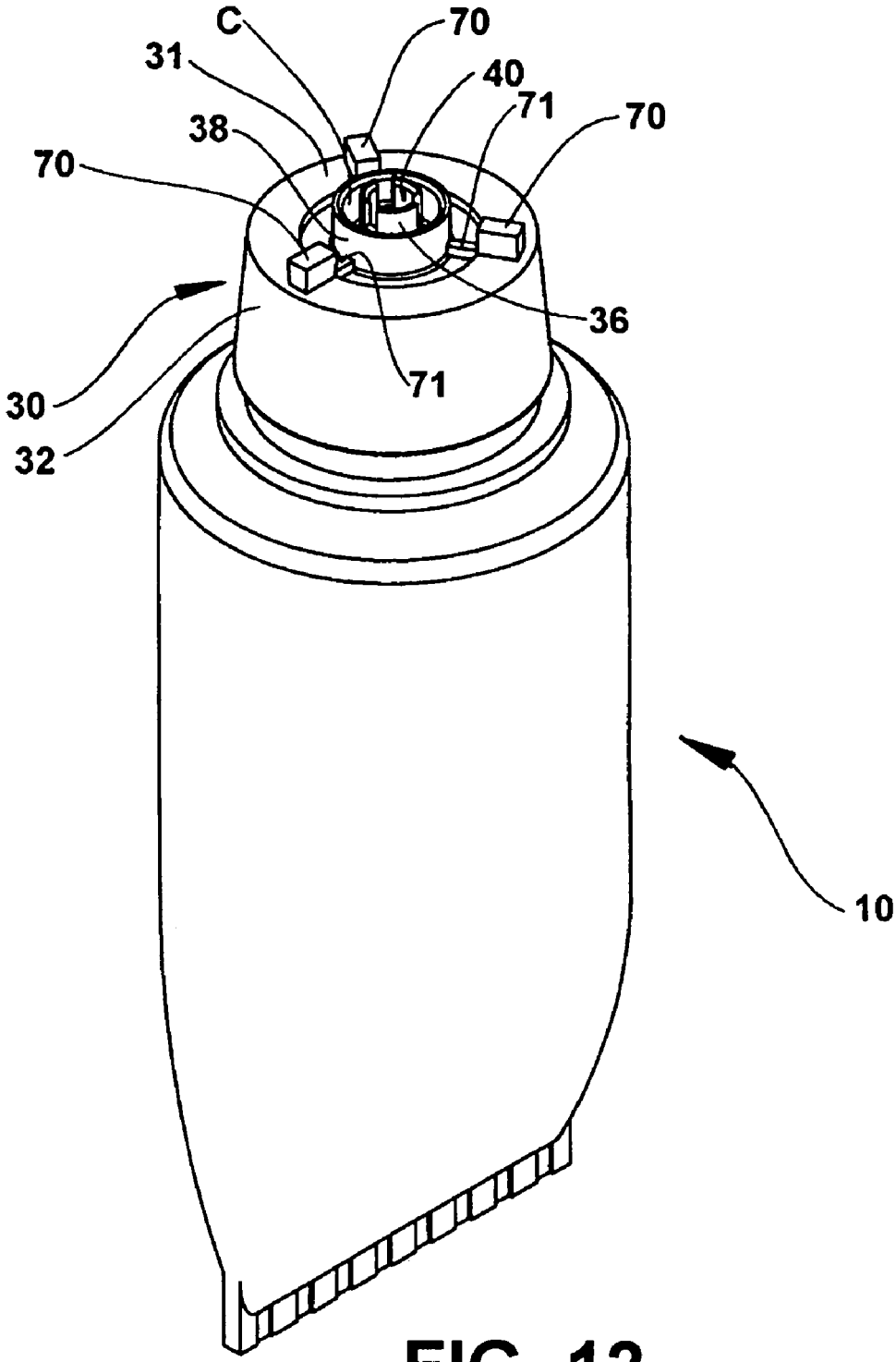
FIG. 12 is a perspective view of a tube, whose nozzle incorporates, in a single piece, the insert that defines the seat of the closing device according to a second embodiment.
Figure 13:
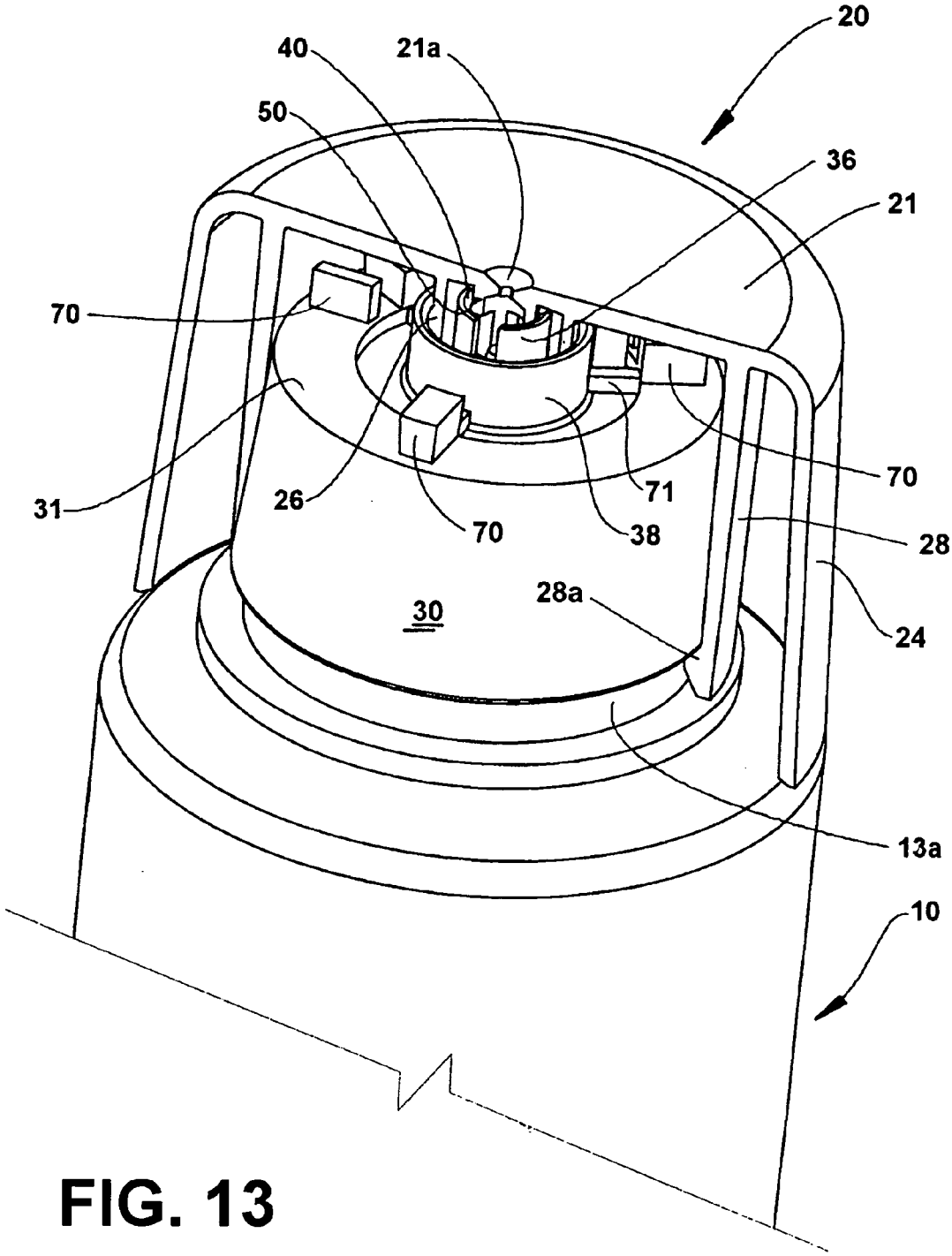
FIG. 13 is a partially cut perspective view of a cap when mounted to the seat of the closing device illustrated in FIG. 12.
Figure 14:
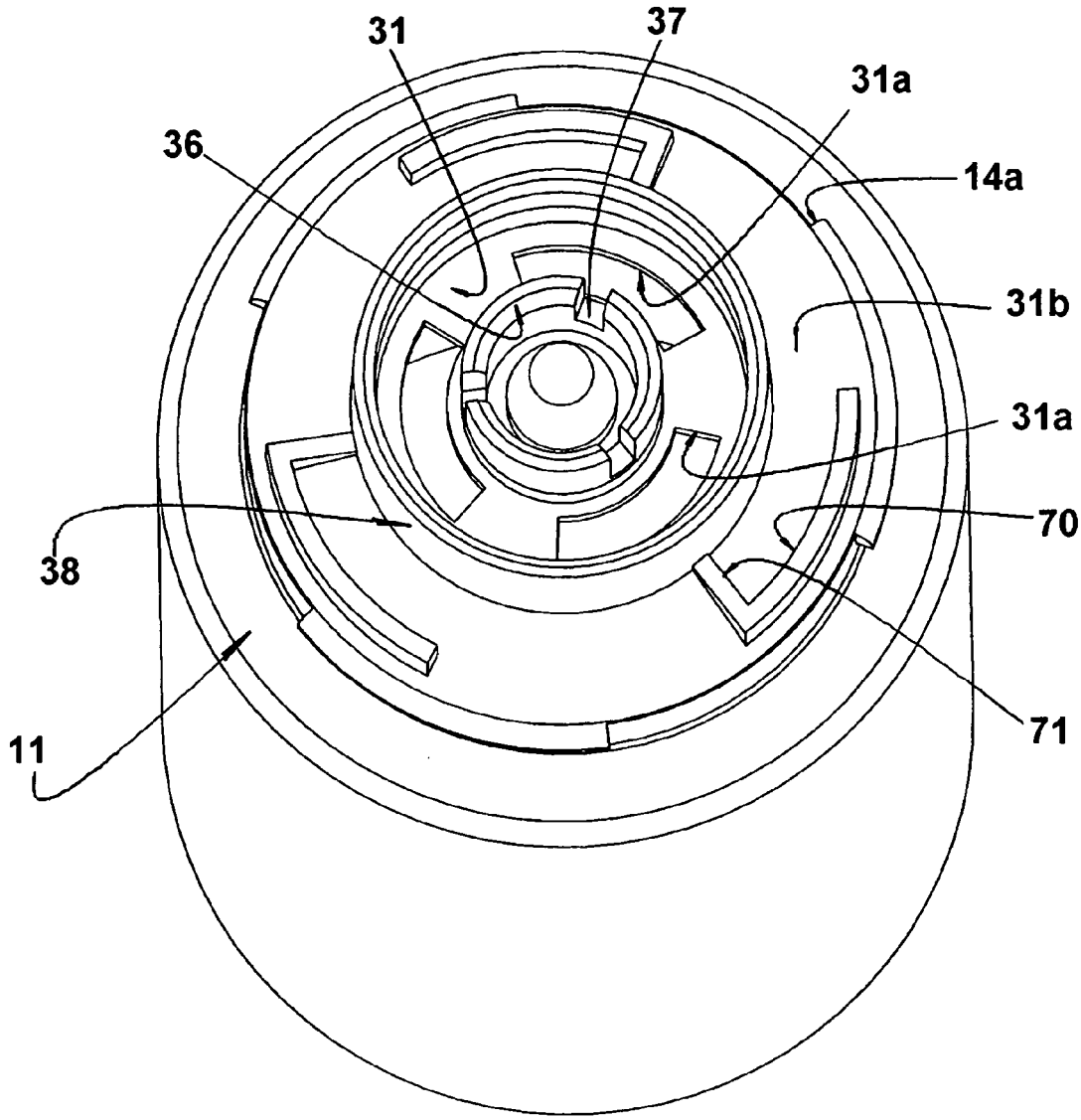
FIG. 14 is an upper perspective view of a third embodiment of the present closing device.
Figure 15:
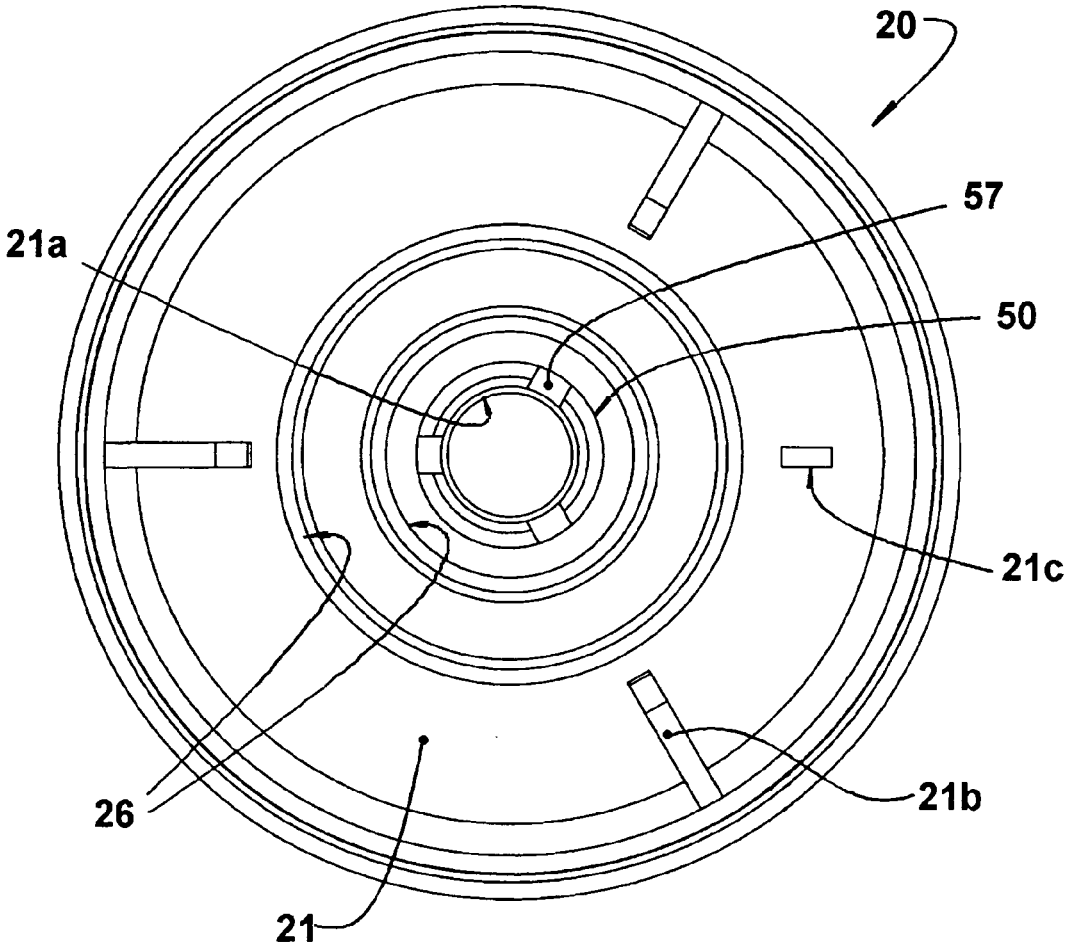
FIG. 15 is a lower plan view of a cap to be used jointly with the closing device of FIG. 14.
Figure 16:
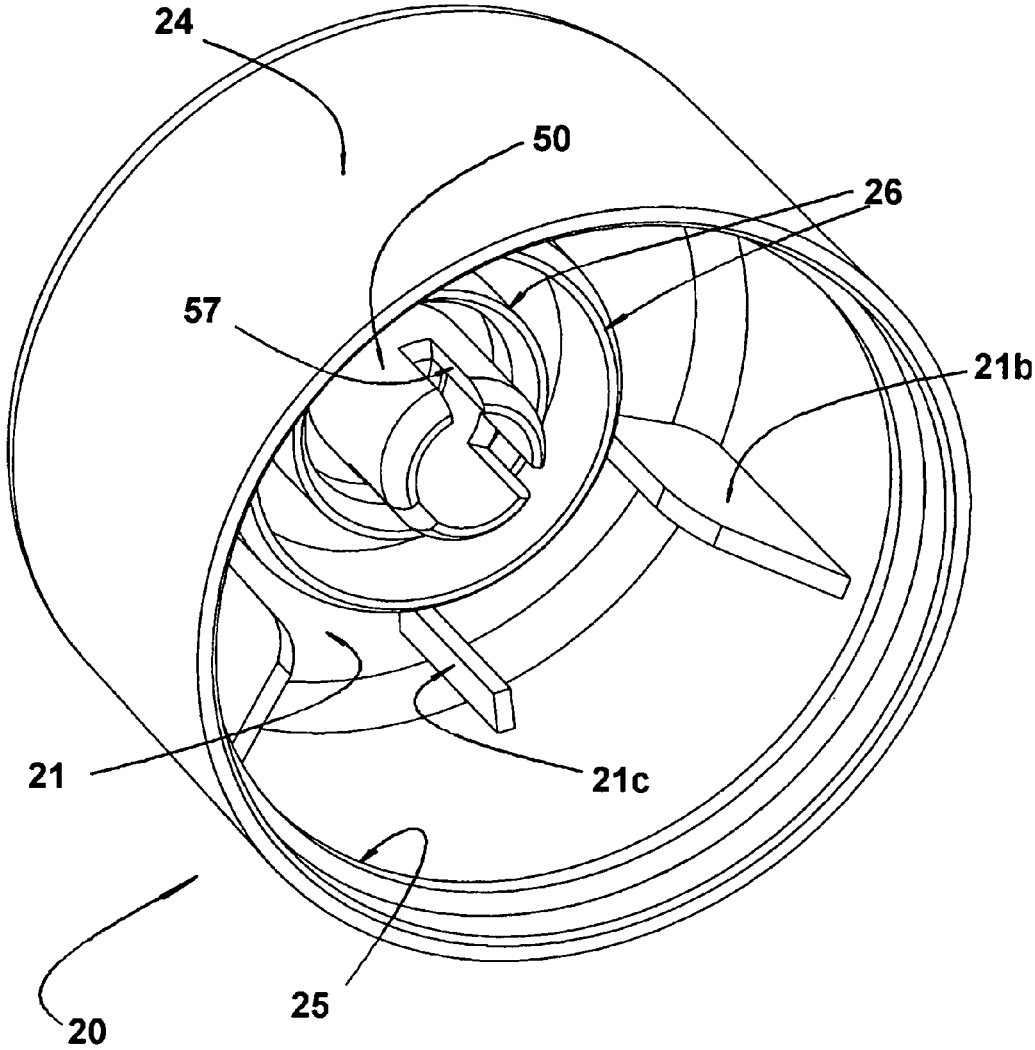
FIG. 16 is a lower perspective view of the cap of FIG. 15.
Figure 17:
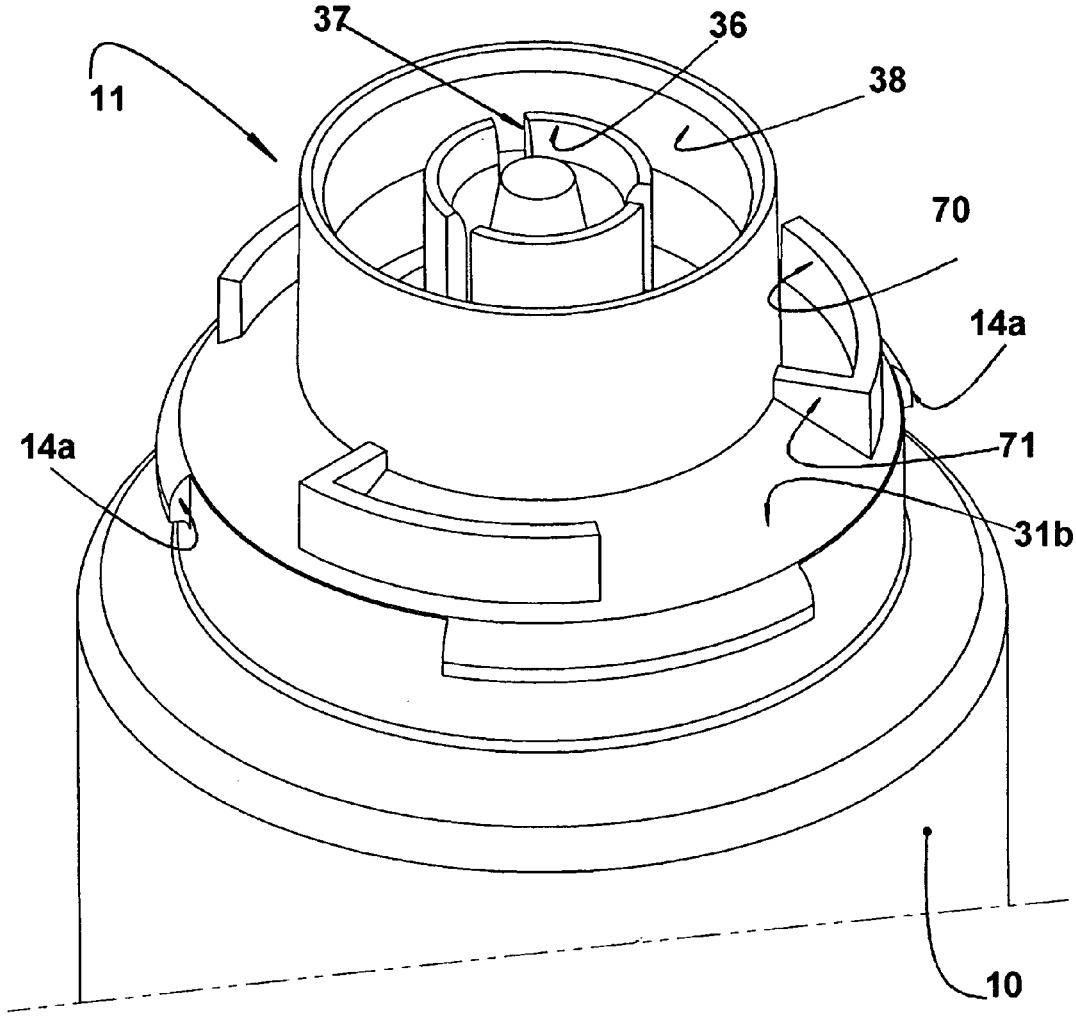
FIG. 17 is an upper perspective view of the closing device of FIG. 14.
Figure 18:
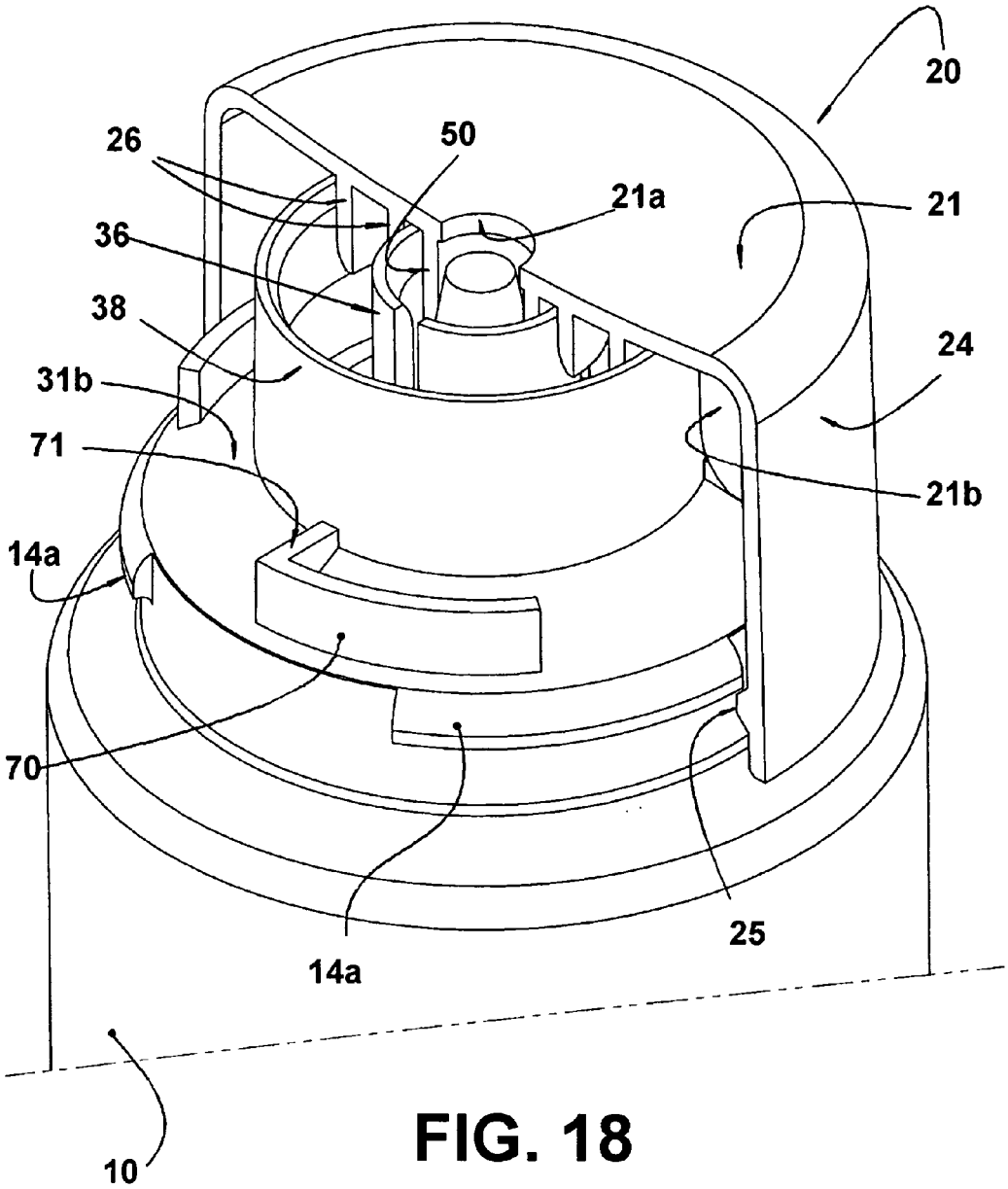
FIG. 18 is a similar view to that of FIG. 17, but further illustrating a partially cut cap mounted onto the seat of the closing device of the third embodiment.
Figure 19:
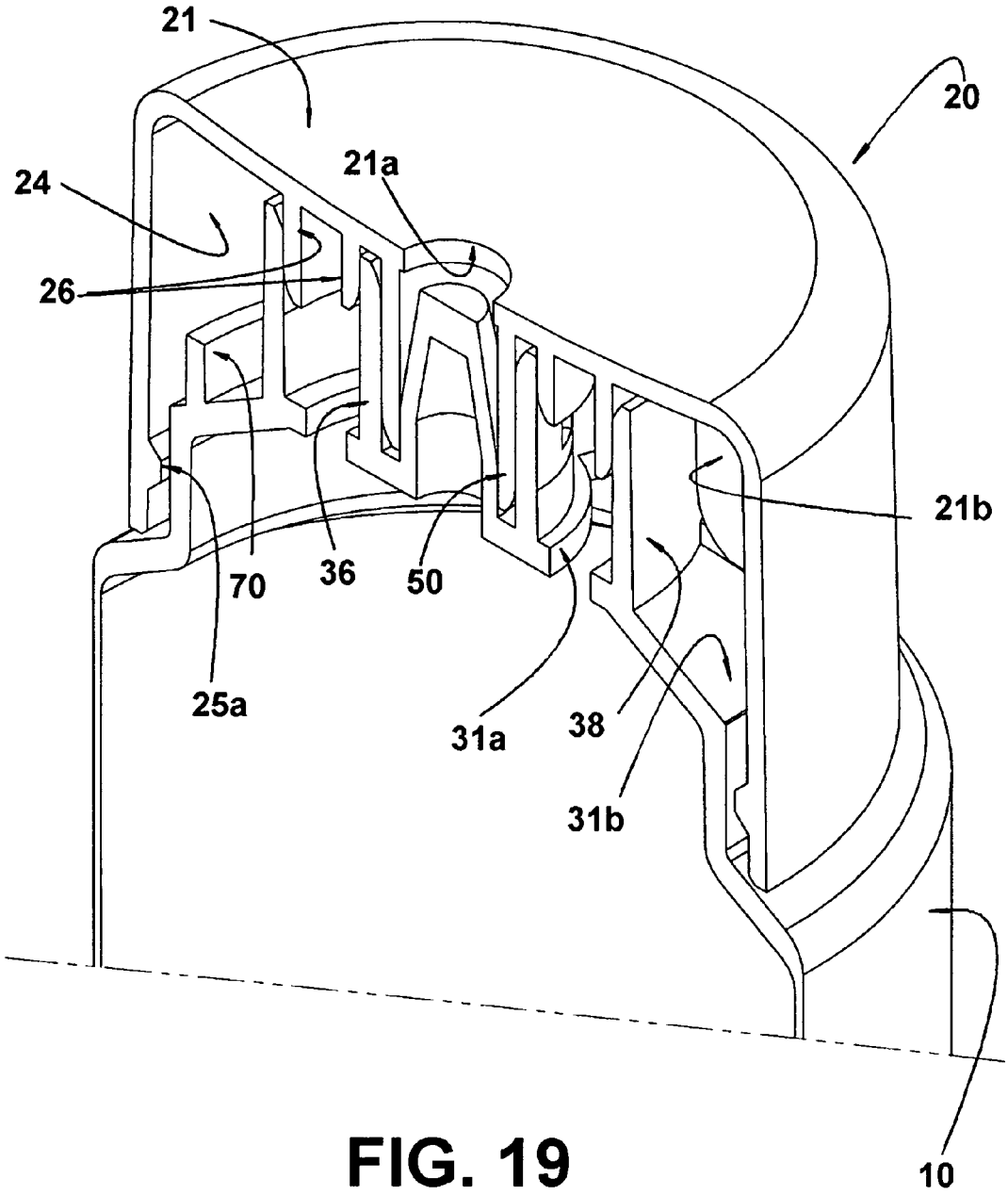
FIG. 19 is a partially cut upper perspective view of the closing device and the cap of FIGS. 14–19.
Figure 20:
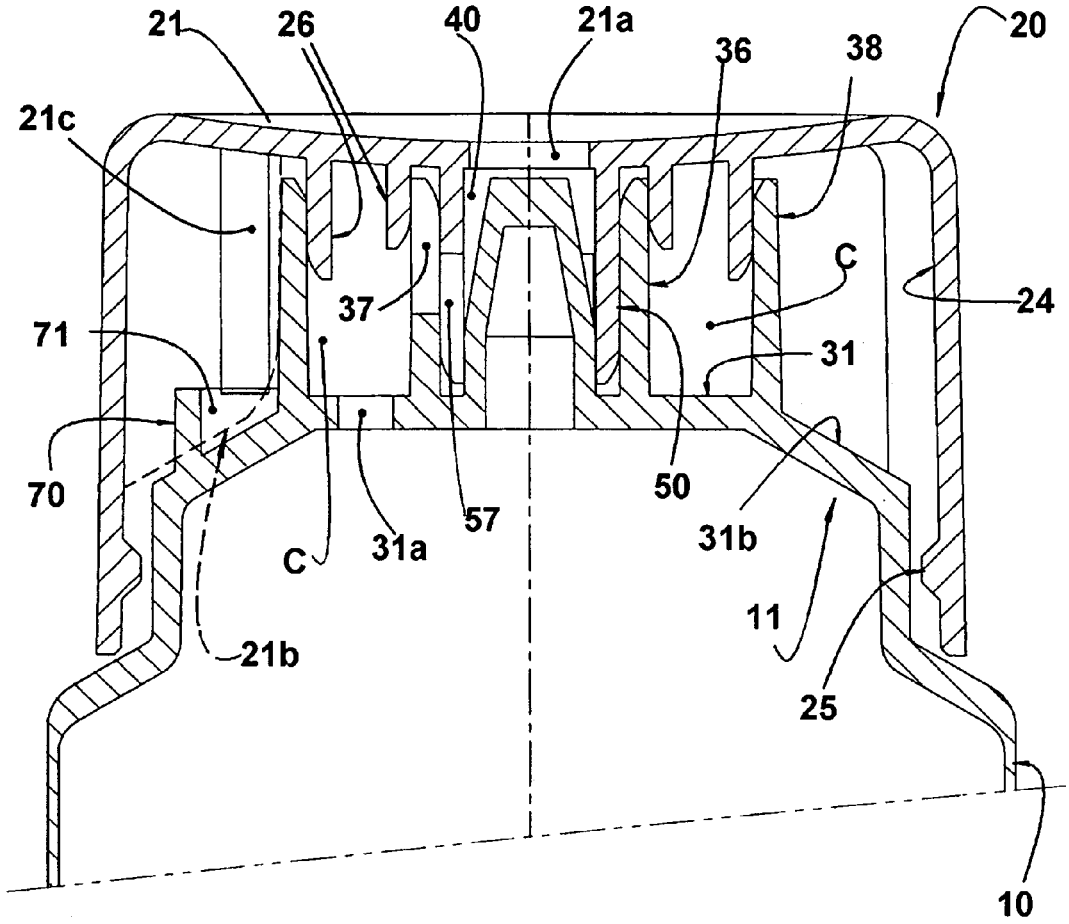
FIG. 20 is a longitudinal sectional view of the closing device and the cap of FIGS. 14–19.

This constructive solution may be applied, for example, to recipients 10 in the form of a tube, as illustrated in FIGS. 12 and 13. In this construction, the insert 30 does not exist and the nozzle 11 incorporates an end wall, which corresponds to the end wall 31 of the insert 30 of the embodiment illustrated in FIGS. 1–11. In this second embodiment, in which the insert 30 is substituted by the nozzle 11 itself, the lateral wall of the latter plays the role of the surrounding lateral wall 32 of the construction illustrated in FIGS. 1–11.

In the second embodiment, applied to tubes, the circumferential salience 13 is replaced by a circumferential recess 13*a*, for fitting and retaining the internal end rib 28*a* of the internal axial tubular wall 28 of the cap 20.

The axial tubular projection 35 and the internal axial nozzle 39 are eliminated, and the throughbore 31*a* in the end wall 31 is maintained for communicating the interior of the recipient 10 with the interior of the annular chamber C.

The other constructive characteristics related to the seat 40, the cylindrical tubular seal 50, the stops 70, the external steps 71, the saliences 21*b*, and the tab 21*c* are the same as those already described in relation to the flask for liquids, as shown in FIGS. 12 and 13.

The present closing device can be used jointly with a tamper evident seal 80, which is made of a single or multilayer film of any adequate material, such as plastic, aluminum, metallic compound, paper, etc., which is adhered to the upper end wall 21 of the cap 20, in order to cover the axial orifice 21*a* of the latter.

As illustrated in FIGS. 14–20, there is provided a third embodiment of the present closing device of the type that can be applied to the recipient 10 illustrated in FIGS. 1–5 or FIGS. 12 and 13, which closing device is formed in a single piece at the upper end of said recipient 10 so as to define the nozzle 11 of the recipient 10.

According to the third embodiment, the recipient 10 further incorporates, externally, in its region close to the nozzle 11, circumferential flap portions 14*a*, below which is slidingly seated and axially retained, by elastic deformation, an internal end rib 25 of the lateral skirt 24 of a cap 20, also constructed in plastic material, incorporating an end wall 21 that covers the nozzle 21 when mounted to the recipient 10. This construction allows the cap 20 to be angularly displaced, by a certain extension, around its longitudinal axis, while remaining axially locked to the recipient 10, by the internal end rib being slidingly seated under the circumferential flap portions 14*a*.

It should be understood herein that the nozzle 11 and the cap 20 could present cross sections different from the illustrated circular cross section, provided that they maintain the circumferential contour of the supporting and locking regions of the cap 20.

For this type of recipient 10, in which the closing device is constructed in a single piece therewith, the nozzle 11, which is generally made of plastic material, defines a tubular body incorporating an end wall 31, which carries a first external axial projection 36 provided with at least one, but preferably three radial windows 37, the first external axial projection 36 being outwardly opened at its free end and shaped so as to define, in its interior, a cylindrical housing that defines the seat 40 of the closing device. The construction of the closing device is made so that the radial windows 37 constitute the single communication between the interior of the seat 40 and the interior of the recipient 10, as described ahead.

Another element of the closing device comprises a cylindrical tubular seal 50 which is preferably defined by an internal axial tubular projection of the upper end wall 21 of the cap 20, said cylindrical tubular seal 50 being dimensioned to be fitted and journalled inside the seat 40 and being able to rotate jointly with the cap 20. The cylindrical tubular seal 50 is provided with at least one, but preferably three radial openings 57, equally angularly spaced from each other and which can be aligned or offset in relation to respective radial windows 37 of the seat 40, as a function of the angular displacement of the cap 20, in order to open and close the closing device, respectively.

Another different aspect of the closing device of the third embodiment relates to the provision of a sealing means 26 defined by a double internal cylindrical tubular projection of the upper end wall 21 of the cap 20 to be seated against the free end of the seat 40, sealing it.

As better illustrated in FIGS. 15, 16 and 18–20, the double tubular projection that defines the sealing means 26 is formed by an external tubular projection and by an internal tubular projection, which are external and concentric in relation to the seat 40 and tightly fitted, rotatably supported between the first external axial tubular projection 36 and a second external axial tubular projection 38 of the end wall 31 of the nozzle 11.

Between the first and the second external axial projection 36, 38 there is defined an annular chamber C which is closed, inferiorly, by the end wall 31 of the nozzle 11 and, superiorly, by the sealing means 26.

The end wall 31 of the nozzle 11 is further provided with at least one, but preferable three throughbores 31*a* which are arcuated, oblong and angularly spaced apart so as to provide constant communication between the interior of the recipient 10 and the interior of the chamber C.

With the new construction described heretofore for the third embodiment of the closing device, it is possible for the cap 20 to remain securely and axially locked to the recipient 10 while being selectively angularly displaced around its axis between an opening position, in which there occurs the alignment between each radial window 37 and a respective radial opening 57, as well as the communication, by means of the throughbores 31*a* and the annular chamber C, between the interior of the recipient 10 and an axial orifice 21*a* for the outlet of the product through the upper end wall 21 of the cap 20, and a closing position, in which the radial openings 57 are offset from the radial windows 37, blocking the communication between the interior of the recipient and the interior of the cylindrical tubular seal 50 which is opened to the outside through the axial orifice 21*a* of the upper end wall 21 of the cap 20.

To limit the rotation of the cap 20 effected by the user, so as to guarantee the easy and simple opening and closing operative conditions, the end wall 31 of the nozzle 11 has is external marginal region, usually in the form of a truncated cone 31*b*, incorporating stops 70, projecting outwardly and arranged in a circumferential development and which are preferably three, so as to guarantee, that in any mounting position of the cap 20, the latter to be rotated in about 60° to be displaced from one operative position to the other.

For this purpose, the upper end wall 21 and the lateral skirt 24 of the cap 20 incorporate internal saliences 21*b* that are displaced between the stops 70 during the rotation of the cap 20 between the opening and closing positions.

Each stop 70 incorporates an internal radial projection 71 that interferes with the path of a tab 21*c*, which is incorporated internally to the upper end wall 21 of the cap 20, in order to produce the sonorous indication to the user about the operative conditions.

While only three embodiments of the present closing device have been illustrated, it should be understood that alterations could be made in the form and arrangement of the component parts, without departing from the concept defined in the claims that accompany the present specification.

The invention claimed is:

1. A closing device for recipients in the form of a flask or tube, made of a preferably flexible material and which is provided with a nozzle covered by a cap axially locked in the recipient, in order to be selectively angularly displaced around its axis, comprising:

a seat in the form of a cylindrical housing provided in the nozzle and having an outwardly opened free end, and at least one radial window defining the single communication between the interior of the seat and the interior of the recipient;

a cylindrical tubular seal axially affixed in the interior of the cap having at least one radial opening and being fitted and journalled in the interior of the seat; and a sealing means, incorporated into the interior of the cap and which is seated against the free end of the seat to seal it, said cap having an axial through orifice, opened to the interior of the cylindrical tubular seal and being selectively angularly displaced, around its axis, between an opening position, in which there occurs the alignment between the radial window and the radial opening, as well as the communication between the interior of the recipient and the axial orifice of the cap, and a closing position, in which the radial opening is offset from the radial window, blocking the communication between the interior of the recipient and the interior of the cylindrical tubular seal.

2. A closing device, according to claim 1, wherein the seat is defined in the interior of a first external axial tubular projection incorporated into an end wall of the nozzle in order to close an end edge of the latter, wherein said first external axial tubular projection being provided with at least one radial window.

3. A closing device, according to claim 2, wherein the cap comprises an upper end wall incorporating a lateral skirt, said upper end wall being provided with the axial orifice, and the sealing means being defined by an internal projection of the upper end wall of the cap.

4. A closing device, according to claim 3, wherein the sealing means is in the form of a tubular projection, external and concentric in relation to the seat and which is tightly fitted and journalled in the interior of a second external axial tubular projection of the end wall, there being defined, between said first and second external axial tubular projections, an annular chamber which is closed, inferiorly, by the end wall and, superiorly, by the sealing means, said annular chamber being maintained in communication with the interior of the recipient by means of a throughbore provided in the end wall.

5. A closing device, according to claim 4, wherein the cylindrical tubular seal is defined by an internal axial tubular projection of the upper end wall of the cap.

6. A closing device, according to claim 4, wherein the end wall is incorporated in a single piece to the nozzle, blocking the free end of the latter.

7. A closing device, according to claim 6, wherein the nozzle of the recipient is provided with a circumferential recess, the cap being provided with an internal axial tubular wall incorporating an internal end rib to be seated, by elastic deformation of the internal axial tubular wall, on the circumferential recess, axially locking the cap in the recipient.

8. A closing device, according to claim 4, wherein the end wall is defined in an insert in the form of a tubular body comprising a surrounding lateral wall involving the nozzle and being axially rotatably locked in the latter, with the end wall being seated against the free end of the nozzle.

9. A closing device, according to claim 8, wherein the nozzle comprises a plurality of longitudinally disposed external ribs, the surrounding lateral wall of the insert incorporating a plurality of internal ribs, between which the external ribs of the nozzle are fitted, rotatably locking the insert to the nozzle of the recipient.

10. A closing device, according to claim 8, wherein the nozzle comprises, externally, a circumferential salience, the surrounding lateral wall of the insert incorporating an internal end circumferential rib to be fitted under the circumferential salience of the nozzle, axially locking the insert to the recipient.

11. A closing device, according to claim 8, wherein the insert comprises, internally, an axial tubular projection to be tightly fitted in the interior of the nozzle in order to provide the necessary tightness for the junction between the nozzle and the insert.

12. A closing device, according to claim 8, wherein the cap comprises with an internal axial tubular wall incorporating an internal end rib to be seated, by elastic deformation of the axial tubular wall , under a stop provided on the surrounding lateral wall of the insert.

13. A closing device, according to claim 12, wherein the stop is defined by the free end of the surrounding lateral wall of the insert.

14. A closing device, according to claim 8, wherein the end wall incorporates an internal axial nozzle, maintained in communication with the throughbore of the end wall and with the interior of the recipient and receiving and securing the upper end of a collecting tube.

15. A closing device, according to claim 6, wherein the recipient comprises, externally, in its region close to the nozzle, circumferential flap portions, below which is slidingly seated and axially retained an internal end rib of the lateral skirt of the cap .

16. A closing device, according to claim 6, wherein the sealing means is defined by a double internal cylindrical tubular projection of the upper wall of the cap.

17. A closing device, according to claim 6, wherein the end wall of the nozzle comprises throughbores that are arcuated, oblong, and angularly spaced from each other.

18. A closing device, according to claim 2, wherein the end wall of the nozzle comprises, externally, a plurality of stops, with an internal salience of the upper end wall of the cap being positioned between each two consecutive stops, said stops and internal saliences being dimensioned and positioned to cooperate for allowing the angular displacement of both the cap and the cylindrical tubular seal between the opening and closing operative positions of the cap .

19. A closing device, according to claim 18, wherein the angular displacement of the cap between the operative positions is of about 60°.

20. A closing device, according to claim 18, wherein the end wall incorporates the same number of external steps as the stops, one of them interfering with the path of a tab, which is incorporated, internally, into the upper end wall of the cap when the latter is angularly displaced between its opening and closing operative positions, producing a "click" sound indicating an alteration occurred in the operative condition of the closing device.

21. A closing device, according to claim 1, further comprising a tamper evident seal made of a single or multilayer film, which is adhered to the cap so as to cover the axial orifice of the latter.

* * * * *